United States Patent [19]

Thompson

[11] Patent Number: 4,669,608

[45] Date of Patent: Jun. 2, 1987

[54] DRINK CONTAINER

[76] Inventor: Roger E. Thompson, 205 Greenhill Road, Eastwood, Australia, 5063

[21] Appl. No.: 819,245

[22] Filed: Jan. 15, 1986

[30] Foreign Application Priority Data

Jan. 23, 1985 [AU] Australia ..... PG9000

[51] Int. Cl.[4] ..... B65D 1/00; B65D 25/38

[52] U.S. Cl. ..... 206/217; 229/7 S; 215/1 A; 220/254

[58] Field of Search ..... 229/7 S; 215/1 A; 206/217; 220/20, 21, 254

[56] References Cited

U.S. PATENT DOCUMENTS 3,915,296 10/1975 Spencer ..... 206/217

4,191,302 3/1980 Fiducia ..... 229/7 S 4,441,640 4/1984 Lottick ..... 229/7 S 4,573,631 3/1986 Reeves ..... 229/7 S

*Primary Examiner*—Joseph Man-Fu Moy

*Attorney, Agent, or Firm*—Brown, Martin, Haller & Meador

[57] ABSTRACT

A drink container which has a hollow transparent tube containing a separator which will separate drinks of different types, the lower end cap of the container having a sipping tube extending therefrom so that the lowermost drink can initially be consumed, whereupon the separator deposits into a hollow cavity in the lower end cap and the next drink can be consumed, the upper end cap of the tube being releasable to open a breather opening which allows the fluid level within the tube to descend as the drink is consumed.

7 Claims, 4 Drawing Figures

DRINK CONTAINER

This invention relates to a container which is useful for containing a plurality of different types of drinks separated from one another, and for extracting those drinks from the container consecutively.

There is a need for a novelty type container which can contain a plurality of drinks, for example of varying colours and flavours, separated from one another and which can be sipped without any great danger of spillage, and to meet this requirement in this invention a container consists of a length of tube having a transparent wall, at least one cup washer contained in the tube, a base at the lower end of the tube having a circular wall defining a cavity of greater diameter than the tube, a filler cap removably secured to the base to functon as a lower closure member, an upper closure member at the upper end of the tube, a breather opening in the upper closure member, a releasable upper cap on the upper closure member having means thereon which closes the breather opening, and a sipping tube in fluid flow communication with the space defined by the base wall.

A container according to this invention containing the separated drinks can be shaken, carried or transported, without the different drinks mixing. They will always remain separated within the one container but will provide the ability to drink the contents without actually "opening" the container. It also means that different "types" of liquids can be contained in the same container, for example, milk, juice, and water. The container can be filled any number of times with different combinations. For refill, the container can be inverted, the filler cap removed, and different types of drinks can be inserted within the container and separated by cup washers, and if for example the different types of drinks are identifiable by colour, the colours can be readily visible through the transparent tube. After filling, the filler cap can be replaced and the sipping hose can be used at any time for withdrawing the contents of the container. When not in use, the sipping hose can be closed by positioning over an upstanding stud on the upper closure member and this will arrest any spillage which might otherwise occur through inadvertent actuation of the non-return valve, although use of the stud is not essential in all embodiments.

Figure 2:
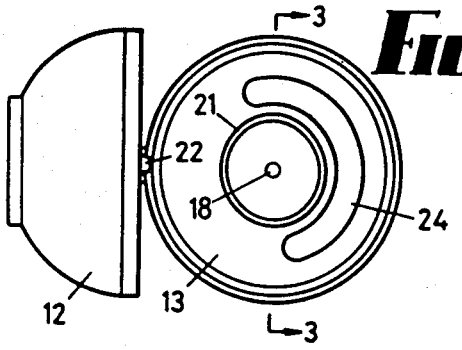
Figure 1:
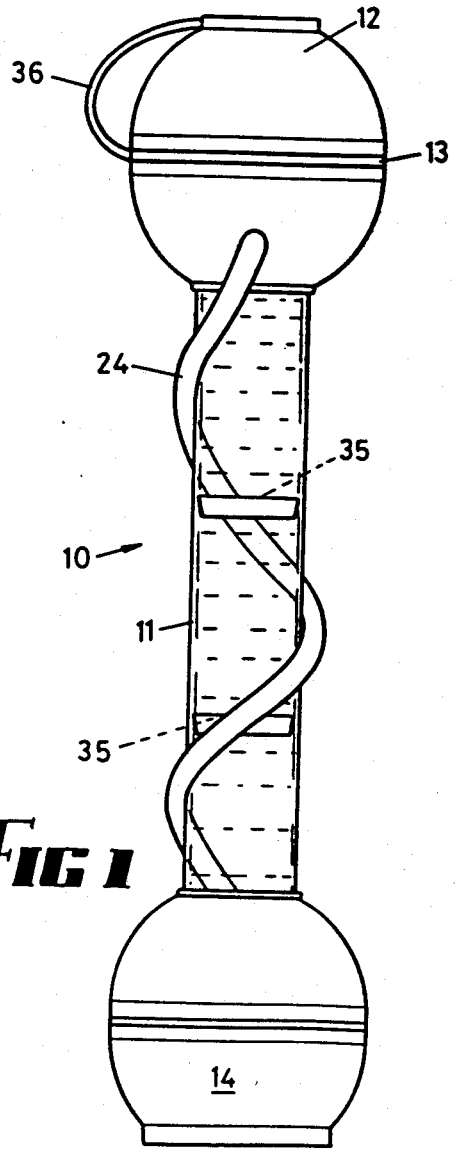
Figure 3:
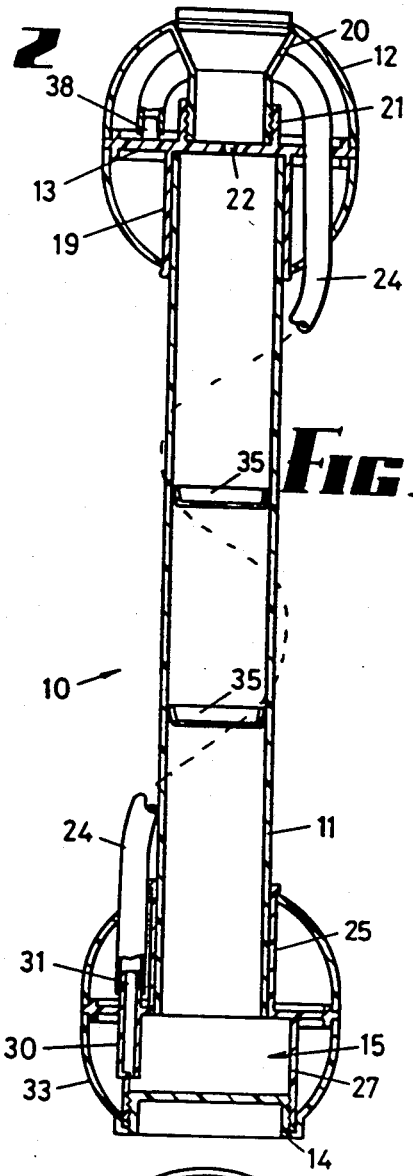
Figure 4:
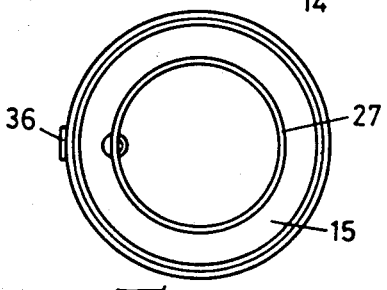

An embodiment of the invention is described hereunder in some detail with reference to, and is illustrated in, the accompanying drawings, in which FIG. 1 is a side elevation of a drink container, FIG. 2 is a top view of same, but with the upper cap shown lifted away from the upper closure member, FIG. 3 is a section on line 3—3 of FIG. 2, and FIG. 4 is an underside view, of FIG. 3, but with the lower cap removed from the lower closure member.

In this embodiment a drink container 10 comprises a length of transparent tube 11 with an upper cap 12 on an upper closure member 13 and a lower cap 14, which functions as a lower closure member and a filler cap, on a base 15 on the lower end.

The upper closure member 13 has a central breather opening 18 and it also has a sleeve 19 which surrounds and sealably engages the upper end of the transparent tube 11. The upper cap 12 has a central hollow stem 20 which threadably engages a flange 21 upstanding from closure member 13, and a central projection 22 which closes the breather opening 18, but upon removal, exposes a "sipping tube" 24 and opens the breather opening 18.

The lower end of the transparent tube 11 terminates within the base 15 by engagement with the sleeve wall 25, but above the bottom of the base, and a circular wall 27 defines a cavity 28 of larger diameter than, and below, the lower end of the transparent tube 11. The circular wall 27 also has an outstanding base 30 therein and a nipple 31 upstanding from the boss to which the lower end of the sipping hose 24 is secured by resilient deformation of the hose itself. The nipple 31 allows access through the boss 30 to the cavity 28 in the base 15 of the container 10. The lower end of the base wall 27 contains a female thread, and this is threadably engaged by a filler cap 33, which also seals against the rim at the lower end of the circular wall 27.

Within the container 10 there are two cup washers 35 spaced from one another in an axial direction.

When it is required to fill the drink container, the container is inverted and firstly a drink of one colour and flavour is poured into the tube 11 and a first cup washer 35 is lowered over the top of that liquid. A second drink is then poured in and the second cup washer 35 is lowered over the top of the second drink, and finally the third drink is poured into the container and this is retained by screwing the filler cap 33 back in position.

Upon inversion, the upper cap 12 can be unscrewed to open the breather opening 18 and expose the sipping tube 24, the cap 12 being retained to the cap by a flexible strap 36. The upper end of the sipping tube 24 is removed from an upstanding retaining stud 38, and the lowermost drink in the container can be drawn out by suction. As this happens, the cup washers 35 follow the surface down until the lowermost drink has been exhausted, and at that time the lower of the washers 35 falls into the large cavity 28 within the base 25 and beneath the lower end of the transparent tube 11. This action is repeated to consume the second drink, whereupon further consumption will empty the entire container, and upon refill being required, this is achieved by unscrewing the filler cap 33 and lifting out the two cup washers 35 and filling as said above. A consideration of the above embodiment will indicate that the invention provides a useful novelty arrangement which has particular appeal to children, and fulfills a need which has not previously been identified.

I claim:

1. A drink container which can contain a plurality of drinks separated from one another, comprising a length of tube having a transparent wall, at least one cup washer contained in the tube, a base at the lower end of the tube having a circular wall defining a cavity of greater diameter than the tube, a filler cap removably secured to the base to function as a lower closure member, an upper closure member at the upper end of the tube, a breather opening in the upper closure member, a releasable upper cap on the upper closure member having means thereon which closes the breather opening, and a sipping tube in fluid flow communication with the space defined by the base wall.

2. A drink container according to claim 1 further comprising means on the upper closure member releasably retaining and closing the upper end of the sipping tube.

3. A drink container according to claim 2 wherein said sipping tube retaining means comprises a stud upstanding from the upper closure member.

4. A drink container according to claim 1 wherein said breather opening closure means comprises a projection on the upper cap which enters the breather opening when the upper cap engages the upper closure member.

5. A drink container according to claim 1 wherein the upper closure member comprises an upwardly directed circular flange containing a thread, and the upper cap comprises a depending hollow stem having a thread complementary thereto.

6. A drink container according to claim 1 wherein said circular wall comprises a thread, and said filler cap comprises a thread complementary thereto, and when closed said filler cap seals against a rim at the lower end of said circular wall.

7. A drink container according to claim 1 wherein said circular wall comprises a hollow boss which opens into said cavity, and the lower end of said sipper tube engages said hollow boss.

* * * * *